US005664668A

United States Patent [19]

Zainal et al.

[11] Patent Number: 5,664,668

[45] Date of Patent: Sep. 9, 1997

[54] TACTILE BUTTON WITH SNAPPED ON PIVOT AND DEFLECTING MECHANISM

[75] Inventors: Abidin bin Mohammed Yahya Zainal; Chong Heng Choy; Tuck Soon Loke; Chee Thiam Tai, all of Singapore, Singapore

[73] Assignee: Motorola, Inc., Schaumburg, Ill.

[21] Appl. No.: 707,040

[22] Filed: Aug. 30, 1996

Related U.S. Application Data

[63] Continuation of Ser. No. 306,054, Sep. 14, 1994, abandoned.

[51] Int. Cl.[6] ..... H01H 3/20

[52] U.S. Cl. ..... 200/332; 200/330; 200/335

[58] Field of Search ..... 200/330, 331, 200/332, 335, 336, 341, 343, 379

[56] References Cited

U.S. PATENT DOCUMENTS

| | | | |
|---|---|---|---|
| 2,761,936 | 9/1956 | Verkuil | 200/343 |
| 2,900,958 | 8/1959 | Johnson | 200/343 |
| 3,250,882 | 5/1966 | Campbell et al. | 200/343 |
| 4,136,270 | 1/1979 | Wernet et al. | 200/343 |
| 4,172,217 | 10/1979 | Miller | 200/343 |
| 4,434,340 | 2/1984 | Kondo | 200/330 |
| 4,613,853 | 9/1986 | Hosogoe et al. | 200/343 |
| 5,319,996 | 6/1994 | Harris | 200/330 |

*Primary Examiner*—David J. Walczak

[57] ABSTRACT

A tactile button (10) for activating a tact switch disposed on electronic circuitry enclosed within a housing element (102) having a shoulder slot (106). The shoulder slot (106) is integrally disposed with a shoulder ledge (108) with two pivot slots (110,112) and an underside flange (114). The shoulder member (104) couples to the shoulder slot (106) and comprises an actuating stub (202), a second latch (204), and two pivot protrusions (208,208). The tact switch is activated by the actuating stub (202) when depressing on an outer surface (216) of the shoulder member (104) and movement of the shoulder member (104) is restricted to an angular direction (304) that pivots on the pivot slots (110, 112). In an alternate embodiment, a portable electronic device (40) has a left tactile button (402) and a right tactile button (404) and inadvertent activation of either tactile button is prevented because activation of either tactile button (402,404) is not laterally but from a top portion of the outer surface (216).

8 Claims, 4 Drawing Sheets

TACTILE BUTTON WITH SNAPPED ON PIVOT AND DEFLECTING MECHANISM

This is a continuation of application Ser. No. 08/306,054, filed Sep. 14, 1994 and now abandoned.

FIELD OF THE INVENTION

This invention relates in general to tactile buttons for an electronic device and in particular to a tactile button for a portable electronic device.

BACKGROUND OF THE INVENTION

A tactile button provides a physical interface between a user and a switch that activates a selectable feature in an electronic device. Conventionally, a tactile button is assembled with a molded housing that encloses electronic circuitry that includes switches.

One method of forming a tactile button uses a molded piece of rubber or soft resin to directly depress a type of switch known as a tact switch. However, this method of forming the tactile button is prone to an infolding of the molded piece of rubber or soft resin when depressed, leading to undesirable jamming.

Inadvertently activating a user selectable feature can result from poorly positioning a tactile button, particularly for a portable electronic device that is small and has more than one tactile button. Activating one selectable feature using a first tactile button sometimes causes unwanted activation of another selectable feature from a second tactile button.

Ongoing developments to improve a portable electronic device include both portability and cost. For portability reasons, using small components, Including tactile buttons, is necessary. However, selected components, though small, will still need to withstand mechanical stresses resulting from accidental drops or knocks. Cost can be reduced by easy assembly and using less components. Hence, a tactile button improving on portability and cost will also need to consider part durability and ease of assembly.

Thus, what is needed is an apparatus to provide an effective, durable, and low cost tactile button for portable electronic devices such as selective call receivers.

SUMMARY OF THE INVENTION

In carrying out the objects of the present invention in one form, there is provided a tactile button for activating a tact switch disposed on electronic circuitry enclosed within a housing element. The tactile button comprises a shoulder member for coupling to a shoulder slot on the housing element. The shoulder member comprises an actuating stub, integrally molded with and disposed on an inner surface, for activating the tact switch. The shoulder member also comprises a deflecting latch, integrally molded with and disposed on the inner surface, for latching onto and deflecting off a shoulder ledge of the shoulder slot. The shoulder member further comprises two pivot protrusions, integrally molded with and disposed on a surface, for coupling to two pivot slots disposed on the shoulder ledge.

DETAILED DESCRIPTION OF THE INVENTION

Figure 1:
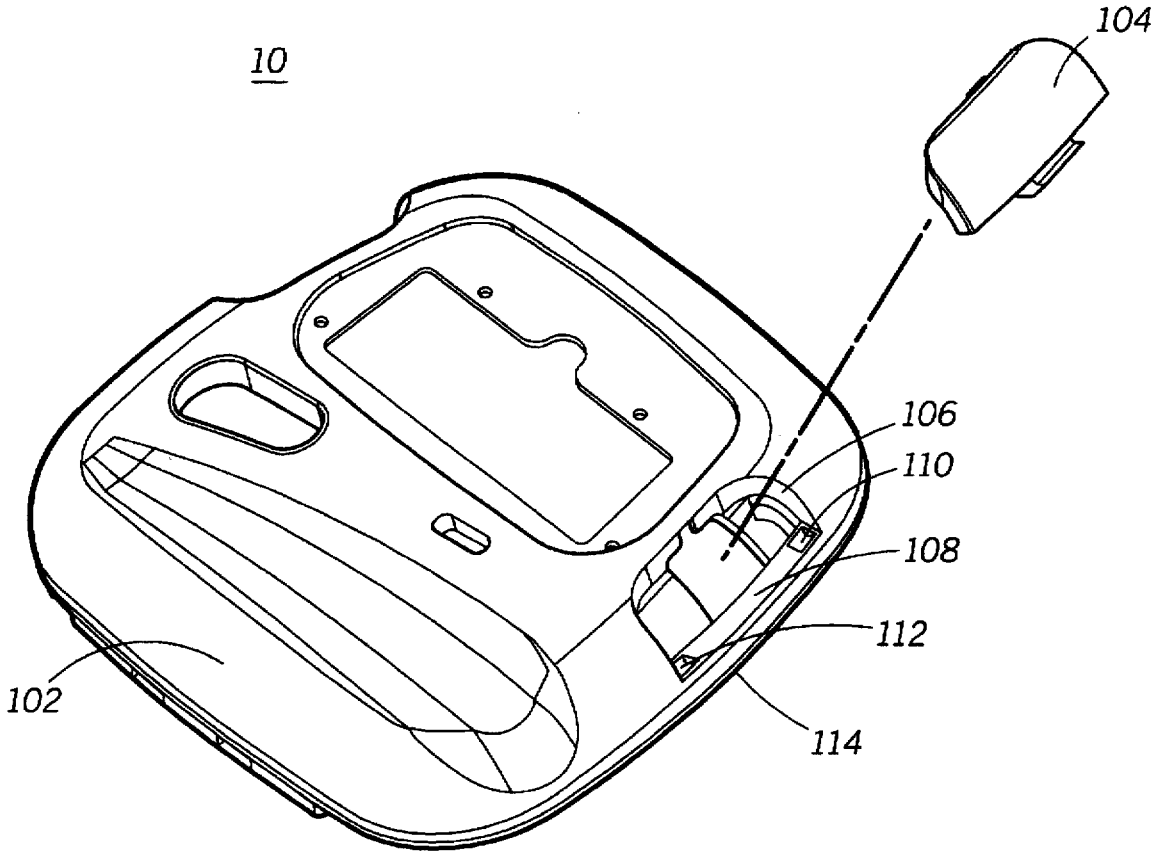
FIG. 1 shows a housing element and a shoulder member in accordance with a preferred embodiment of the present invention.

In accordance with a preferred embodiment of the present invention, FIG. 1 shows a portable electronic device 10 having a button assembly comprising a housing element 102 and a shoulder member 104. Forming part of a molded housing for enclosing electronic circuitry that includes a tact switch, the housing element 102 comprises a shoulder slot 106. Integrally disposed with two pivot slots 110, 112 on a shoulder ledge 108, the shoulder slot 106 has an upper ledge a top surface and an underside flange 114 on the bottom and couples to the shoulder member 104 to thereby allow the shoulder member 104 to activate the tact switch in accordance with the preferred embodiment of the present invention.

Figure 2:
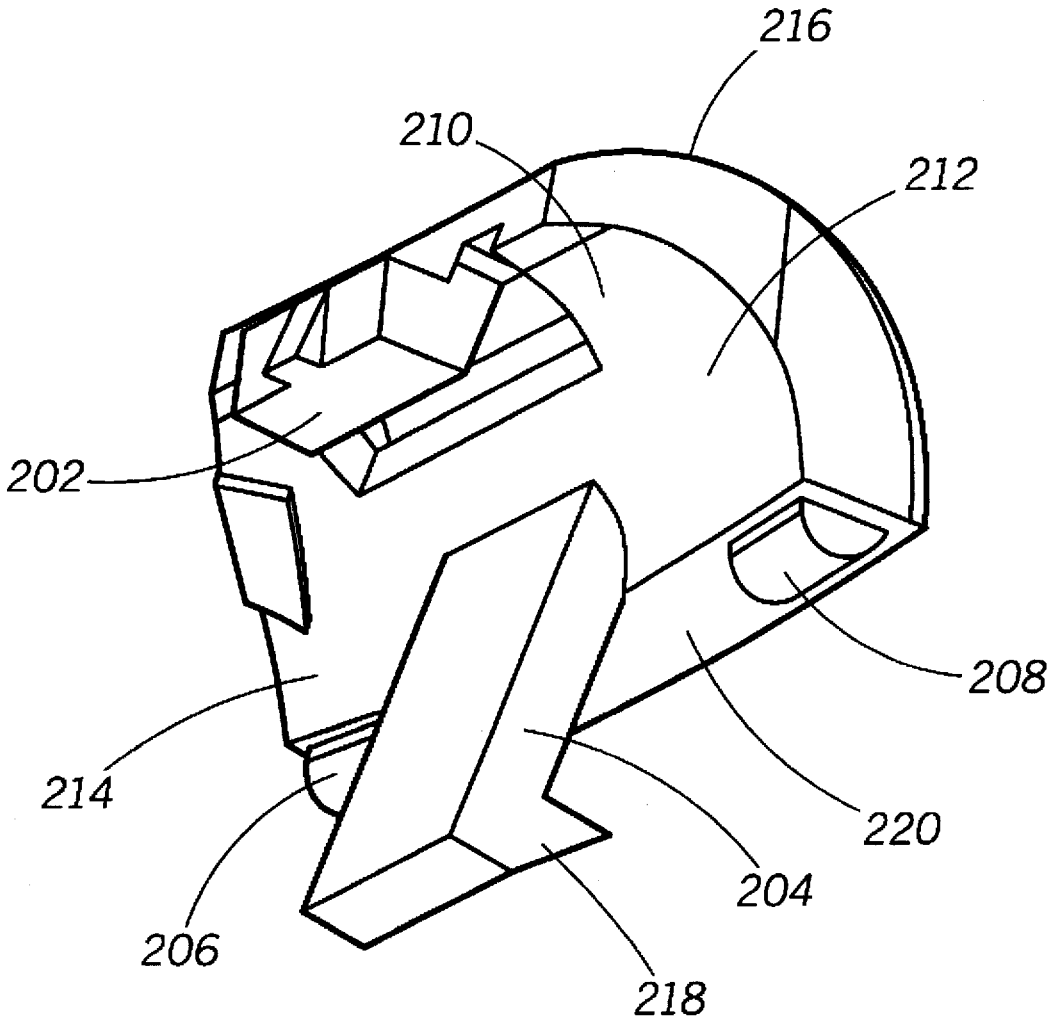
FIG. 2 is an isometric perspective of the shoulder member of FIG. 1 in accordance with the preferred embodiment of the present invention.
Figure 3:
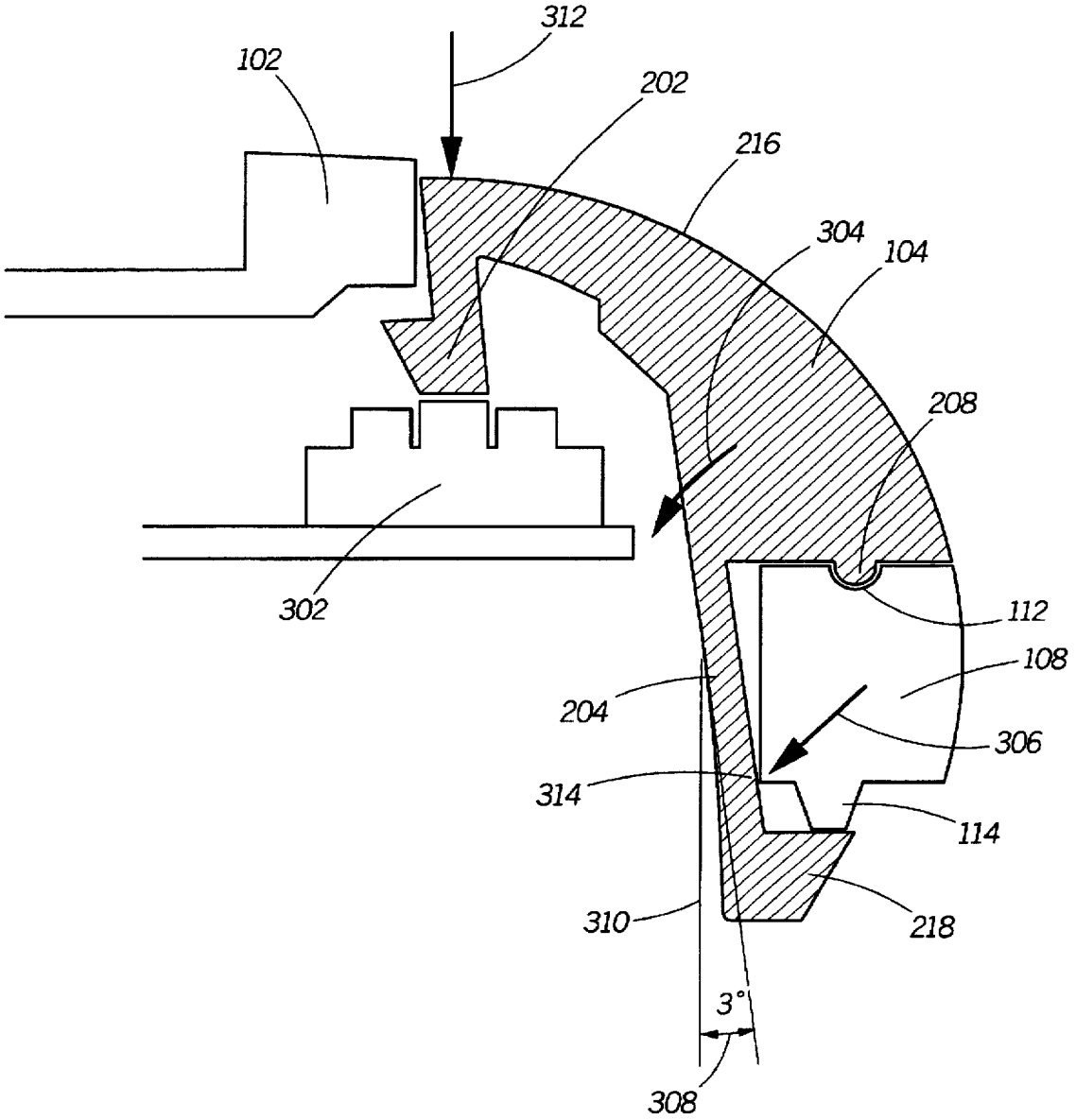
FIG. 3 is a side perspective of the shoulder member of FIG. 1 coupling to the housing element 102 of FIG. 1 and engaging a tact switch in accordance with the preferred embodiment of the present invention.

In accordance with the preferred embodiment of the present invention, FIG. 2 shows an isometric perspective of the shoulder member 104 of FIG. 1. As shown in FIG. 2 and FIG. 3, the shoulder member 104 is arcuately shaped, traversing substantially through a right angle from a first end 210 to a second end 214 distal therefrom, and pivotally mounted within the shoulder slot 106. The shoulder member 104 comprises an actuating stub 202, a second latch 204, and two pivot protrusions 206,208. Integrally molded with and disposed on an inner or rear surface 212 at the first end 210 of the shoulder member 104 below the upper ledge, the actuating stub 202 extends from the inner or rear surface 212. When the shoulder member 104 is depressed on an outer surface 216, the actuating stub 202 is pushed into the housing element 102 to activate the tact switch. The second latch 204 is also integrally molded with and disposed on the inner or rear surface 212, but extends from the second end 214 of the shoulder member 104 and comprises a lateral wedge 218. Integrally and distally disposed on the second latch 204, the lateral wedge 218 latches onto the underside flange 114 of the shoulder slot 106. Pivoting on the pivot slots 110, 112, the pivot protrusions 206,208 restricts movement of the shoulder member 104 to an angular direction when the shoulder member 104 is depressed on the outer surface 216.

FIG. 3 shows a side perspective of the shoulder member 104 of FIG. 1 coupling to the housing element 102 of FIG. 1 and engaging a tact switch 302. Depressing the shoulder member 104 on the outer surface 216 provides an activating force 312 that causes the actuating stub 202 to activate the tact switch 302. When depressed, movement of the shoulder member 104 is restricted to an angular direction 304 that increases a reactive force 306 acting against the second latch 204 by the shoulder ledge 108. This reactive force 306 is enhanced by a tilt 308 of the second latch 204 by about three degrees away from a vertical axis 310 of the housing element 102 and helps to push the shoulder member 104 back to an unactuated position before depressing the shoulder member 104 on the outer surface 216.

Advantageously tilting the second latch 204, therefore, increases the reactive force 306 that returns the shoulder member 104 back to the unactuated position after actuation of the tact switch 302. No additional part is required and part of the activating force 312 enhances the reactive force 306 that returns the shoulder member 104 back to the unactuated position. Furthermore, the tilting causes an interference 314 of the second latch 204 against the shoulder ledge 108 which takes up any tolerance slack in the coupling between the shoulder member 104 and the shoulder slot 106. Having no tolerance slack in this coupling, any intended mechanical vibrations created by the electronic device and used, for example, as an alarm, will not cause an undesirable rattling of the shoulder member 104 against the shoulder ledge 108. Otherwise, a possible consequence of the undesirable rattling is an incorrect perception that the molded housing has a faulty joint at the shoulder member 104 and is therefore defective.

Figure 4:
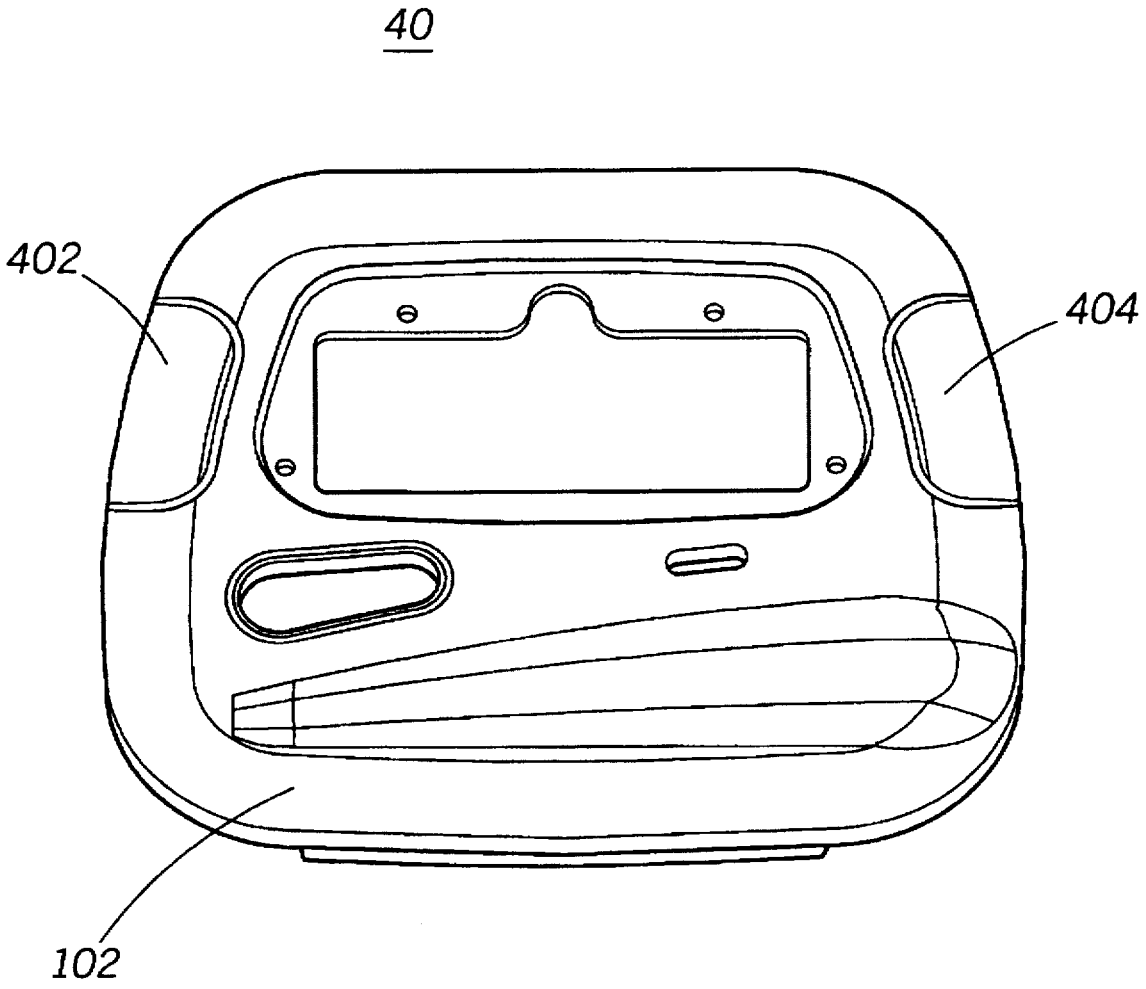
FIG. 4 shows two shoulder members coupled to the housing element of FIG. 1 in accordance with the preferred embodiment of the present invention.

In accordance with the present invention, a portable electronic device 40 comprising the housing element 102 of FIG. 1, a left tactile button 402, and a right tactile button 404 is shown in FIG. 4. In this embodiment, both the left tactile button 402 and the right tactile button 404 operate with the same mechanism as the tactile button 10 in FIG. 1. However, the shape of the housing element 102 requires the left tactile button 402 to physically mirror the right tactile button 404 and, hence, both are not physically identical.

For the portable electronic device 40, a further advantage of the present invention in accordance with the preferred embodiment is that holding the portable electronic device 40 and activating the left tactile button 402 will not cause inadvertent activation of the right tactile button 404 and vice versa. This is possible only because activation of both tactile buttons is from a top portion of the outer surface 216. Otherwise, if activation of the right tactile button 404 is from a sideward direction, a likely consequence, for example, is that a lateral activating force on the right tactile button 404 will transfer laterally to the left tactile button 402, thereby causing concurrent and inadvertent activation of the left tactile button 402.

Other alternate embodiments of the present invention in electronic circuitry of other portable electronic devices having at least one tact switch will provide the advantage of having the reactive force 306 of the second latch 204 restore the shoulder member 104 to the unactuated position. In these other alternate embodiments, any housing element with at least one shoulder slot will couple to at least one shoulder member. With two or more tact switches in any of these other alternate embodiments, a top surface actuation of the at least one tact switch by the at least one shoulder member provides an advantage of the present invention over a conventional tactile button activated laterally. Furthermore, assembly of a tactile button in these other alternate embodiments, in accordance with the present invention, is easy and requires any of the at least one shoulder member to snap onto the underside flange 114 and couple to the at least one shoulder slot. Fabricated from an integrally molded hard resin, no additional parts are required. Using the hard resin also enhances durability and prevents any infolding from occurring.

By now it should be appreciated that them has been provided an effective, durable, and low cost tactile button for activating a tact switch disposed within the electronic circuitry of portable electronic devices, such as selective call receivers.

We claim:

1. A button assembly for activating a tact switch, the button assembly comprising:

a housing element having a shoulder slot integrally disposed with an upper ledge and a shoulder ledge having an underside flange integrally disposed thereat; and an arcuately shaped shoulder member, pivotally mounted within the shoulder slot, traversing substantially through a right angle from a first end to a second end distal therefrom, the arcuately shaped shoulder member includes an inner surface having:

an actuating stub disposed at the first end below the upper ledge for activating the tact switch; and a second latch disposed at the second end for latching onto the underside flange and deflecting off the shoulder ledge.

2. The button assembly of claim 1 wherein the actuating stub extends from the inner surface of the first end.

3. The button assembly of claim 1 wherein the second latch extends longitudinally from the inner surface of the second end.

4. The button assembly of claim 1 wherein the second latch comprises a lateral wedge for latching onto the underside flange.

5. A portable electronic device having electronic circuitry including at least one tact switch, the portable electronic device comprising:

a housing element having at least one shoulder slot integrally disposed with an upper ledge and a shoulder ledge having an underside flange integrally disposed thereat; and at least one arcuately shaped shoulder member, pivotally mounted within a respective shoulder slot, traversing substantially through a right angle from a first end to a second end distal therefrom, each arcuately shaped shoulder member includes an inner surface having:

an actuating stub disposed at the first end below the upper ledge for activating the tact switch; and a second latch disposed at the second end for latching onto the underside flange and deflecting off the shoulder ledge.

6. The portable electronic device of claim 5 wherein the actuating stub extends from the inner surface of the first end.

7. The portable electronic device of claim 5 wherein the second latch extends longitudinally from the inner surface of the second end.

8. The portable electronic device of claim 5 wherein the second latch comprises a lateral wedge for latching onto the underside flange.

* * * * *